US006095210A

United States Patent [19]

Parks

[11] Patent Number: 6,095,210

[45] Date of Patent: Aug. 1, 2000

[54] WOODWORKING SHAPER HEAD

[75] Inventor: Robert Alexander Parks, Morganton, N.C.

[73] Assignee: Drexel Heritage Furnishing, Inc., Drexel, N.C.

[21] Appl. No.: 09/334,162

[22] Filed: Jun. 16, 1999

[51] Int. Cl.[7] ..... B27C 5/00

[52] U.S. Cl. ..... 144/230; 144/218; 144/241; 407/38; 407/45; 407/49

[58] Field of Search ..... 144/218, 229, 144/230, 134.1, 363, 241; 241/292.1, 294; 407/37, 38, 41, 42, 45, 49, 108

[56] References Cited

U.S. PATENT DOCUMENTS

| | | | |
|---|---|---|---|
| 2,186,423 | 1/1940 | Miller | 407/38 |
| 2,814,320 | 11/1957 | Dukes et al. | 144/230 |
| 2,917,091 | 12/1959 | Smith et al. | 144/230 |
| 3,946,474 | 3/1976 | Hahn et al. | 144/230 |
| 4,449,556 | 5/1984 | Colton . | |
| 4,538,655 | 9/1985 | Berkeley . | |
| 4,658,875 | 4/1987 | Grabovac . | |
| 4,830,073 | 5/1989 | De Abreu | 144/230 |
| 4,922,977 | 5/1990 | Colton et al. | 144/230 |
| 5,146,963 | 9/1992 | Carpenter et al. . | |
| 5,163,490 | 11/1992 | Meis . | |
| 5,240,192 | 8/1993 | Tilby et al. . | |

*Primary Examiner*—W. Donald Bray

[57] ABSTRACT

A woodworking shaper head having a plurality of cutting blades mounted about the periphery thereof. Each cutting blade is mounted in a longitudinally extending channel in the surface of the head, and a gib of wedge shape is disposed in the channel to securely retain the blade. The forwardly facing side wall of the channel and the adjacent surface of the blade include intermeshing corrugations which resist withdrawal of the blade during operative rotation of the head.

14 Claims, 2 Drawing Sheets

R
β
W2
50
44
D2
D1
30
32
41
12
51
40
A
52
54
42
W1
32
α
40
50
16
50
14
40
32
10
32
50
40

WOODWORKING SHAPER HEAD

BACKGROUND OF THE INVENTION

The present invention relates to a woodworking planing or shaper head of the type commonly used to shape wooden components of furniture.

Shaper heads of the described type typically comprise a cylindrical base member having a plurality of cutting blades mounted in a spaced apart arrangement about the circumference thereof. The head is mounted for rotation about a vertical axis, and the workpieces to be cut are fed horizontally across a table and into contact with the rotating head, either manually or by an automatic feeder.

Various prior designs of shaper heads have been proposed wherein the cutting blades are mounted in longitudinal channels which are spaced about the surface of a cylindrical base member. One such prior design is illustrated in FIG. 1, wherein the blade B is mounted in a channel C and locked in place by means of a gib G which is biased by a set screws S. Mating corrugations are provided on the rear wall of the channel and the blade, so as to retain the blade in the channel. It will be apparent however, that if the set screws should loosen, both the gib and the blade could be released and fly out of the channel during the high speed rotation of the head, and damage to the equipment or injury to the operator could easily result.

Another prior shaper head design is illustrated in U.S. Pat. No. 5,163,490, wherein the locking gib is of wedge shape and biased against the blade by means of a set screw which extends through the gib in a generally radial direction. Here again, however, it is believed that in the event the set screw should loosen, the gib could drop away from its engagement with the blade such that only the separate retaining screws on the rear side of the blade would resist radial movement of the blade.

It is an object of the present invention to provide a shaper head of the described type which has an improved mounting structure for the blades and gibs, whereby the risk that a blade and gib could be released and fly out of the mounting channel during rotation of the head, is effectively avoided.

SUMMARY OF THE INVENTION

The above and other objects and advantages of the present invention are achieved by the provision of a shaper head which comprises a cylindrical base member which defines a central axis and has at least one longitudinally extending channel in the outer surface thereof, with the channel having a forwardly facing side wall and an opposing rearwardly facing side wall. A cutting blade is positioned in the channel and includes a first surface overlying and engaging the forwardly facing side wall of the channel, and a second surface facing the rearwardly facing side wall of the channel in a spaced apart arrangement, and such that the second surface of the blade and the rearwardly facing side wall of the channel lie in respective planes which converge toward each other in a radially outward direction. A gib of wedge shape in cross section is disposed in the channel, and the gib includes a rear wall overlying and engaging the second surface of the blade, and a front wall overlying and engaging the rearwardly facing side wall of the channel. The forwardly facing side wall of the channel and the first surface of the cutting blade preferably have interengaging longitudinally extending corrugations which serve to resist radially outward movement of the blade from the channel, during operative rotation of the shaper head.

The second surface of the blade and the rearwardly facing side wall of the channel are each inclined at an acute angle with respect to a radial plane which passes outwardly through the channel, and such that the acute angles both open in a radially inward direction.

The shaper head also preferably includes at least one threaded opening extending in a generally circumferential direction and communicating with the rearwardly facing side wall of the channel, and a set screw is threadedly received in the threaded opening so as to engage the front wall of the gib.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF A PREFERRED EMBODIMENT

The present invention now will be described more fully hereinafter with reference to the accompanying drawings, in which a preferred embodiment of the invention is shown. This invention may, however, be embodied in many different forms and should not be construed as limited to the embodiment set forth herein; rather, the described embodiment is provided so that this disclosure will be thorough and complete, and will fully convey the scope of the invention to those skilled in the art.

Figure 1:
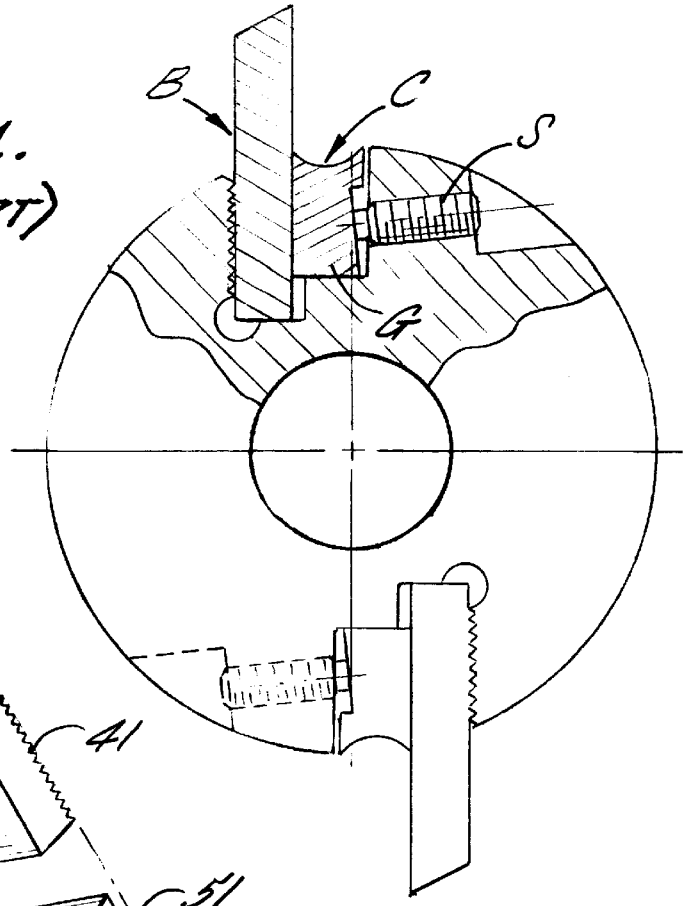
Fig. 1. (PRIOR ART)
FIG. 1 is a sectional side view of a prior art woodworking shaper head.
Figure 2:
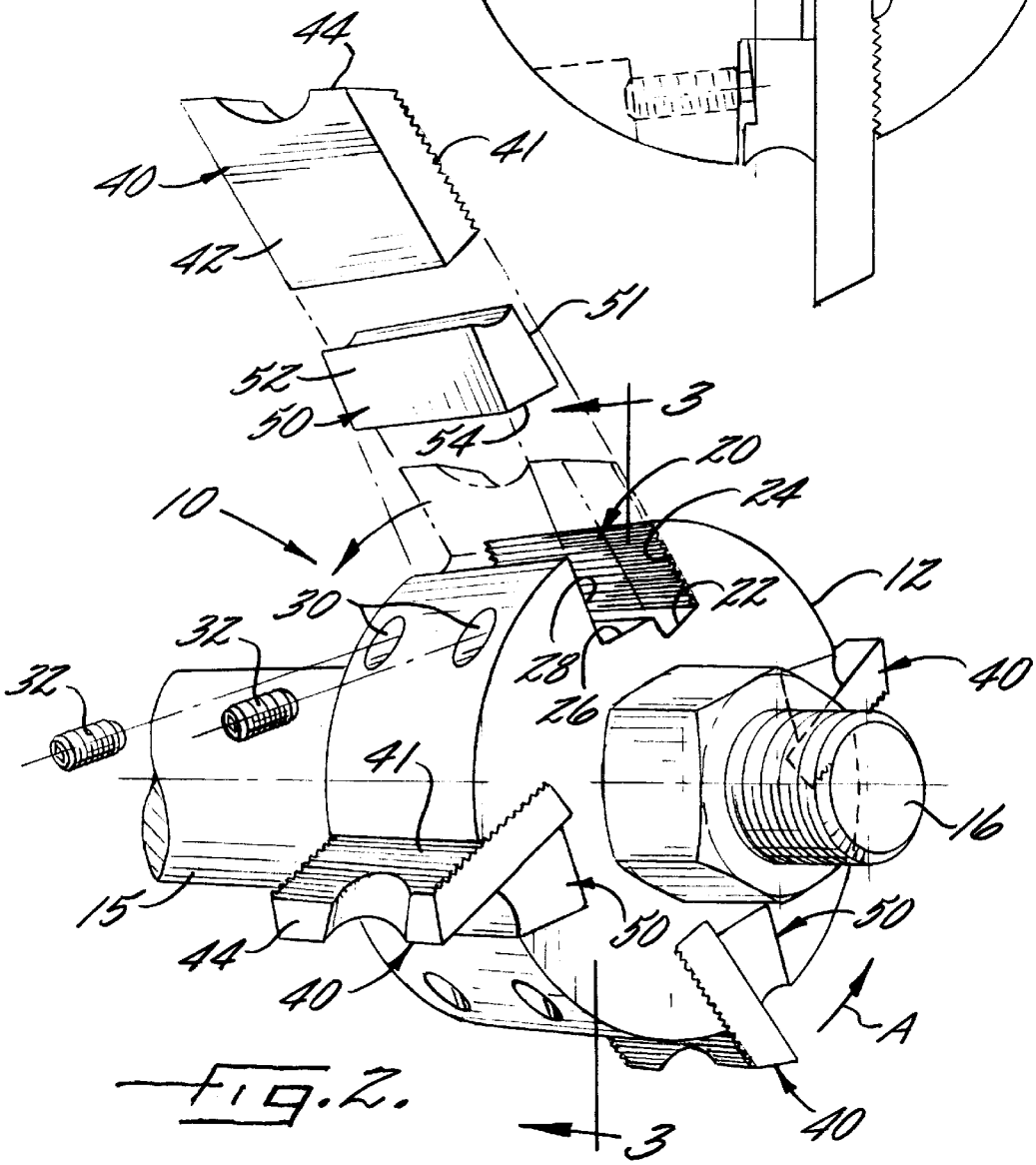
FIG. 2 is a perspective view of a woodworking shaper head which embodies the features of the present invention.
Figure 3:
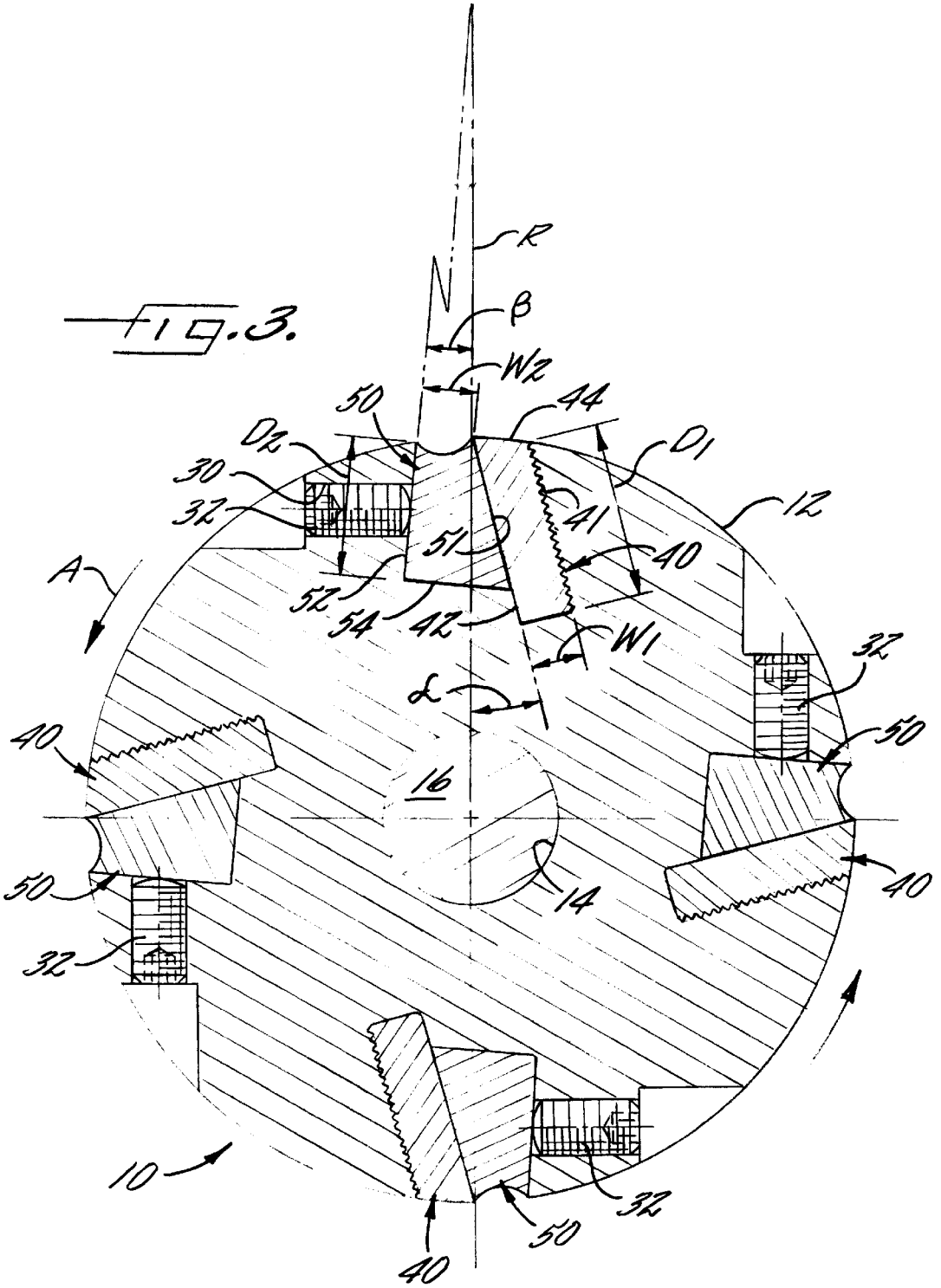
FIG. 3 is a sectional view taken substantially along the line 3—3 of FIG. 2.

Referring more particularly to the drawings, a woodworking shaper head which embodies the features of the present invention is indicated generally at 10 in FIGS. 2 and 3. The shaper head includes a cylindrical base member 12, which is composed of a suitable metal such as steel, and the base member includes a bore 14 extending longitudinally through its central axis, for receiving a supporting shaft 16 in a conventional manner.

The illustrated embodiment of the shaper head includes four blade mounting channels 20 which extend longitudinally along the full length of the base member 12. The four channels 20 are equally spaced about the circumference of the base member, and each channel is composed of a blade receptacle portion which includes a base wall 22 and a forwardly facing side wall 24. Each channel 20 also includes a gib receptacle portion which includes a base wall 26 and a rearwardly facing side wall 28. As will become apparent, the forward and rear side walls 24, 28 refer directionally to the direction of intended rotation of the shaper head, as indicated by the arrows A in FIGS. 2 and 3.

A plurality of threaded openings 30 extend in a generally circumferential direction from the outer surface of the base member and into communication with the rearwardly facing side wall 28. A set screw 32 is threadedly received in each of the openings 30 for the purposes set forth below.

The shaper head 10 further includes a cutting blade 40 positioned in each channel so as to extend along at least a portion of the length thereof. Each cutting blade 40 is fabricated from a conventional tool steel and it includes a first surface 41 overlying and engaging the forwardly facing side wall 24 of the channel, and a second surface 42 facing the rearwardly facing side wall 28 of the channel in a spaced apart arrangement. The first and second surfaces 41, 42 of the blade are generally parallel to each other, and the blade further includes a profiled outer edge portion 44 which lies outside of the channel and extends in the longitudinal direction, and a base wall 46.

A gib 50 of wedge shape in cross section is disposed in each channel. The gibs are preferably composed of a steel material as further described below, and each gib includes a rear wall 51 overlying and engaging the second surface 42 of the associated blade, and a front wall 52 overlying and engaging the rearwardly facing side wall 28 of the channel. The gib also has a bottom wall 54 which is disposed immediately adjacent, and preferably in contact with, the base wall 26 of the gib receptacle portion of the channel.

Since the first and second surfaces 41, 42 of the blade are parallel to each other, it will be seen that the second surface 42 of the blade and the rearwardly facing side wall 28 of the channel are each inclined at an acute angle $\alpha$ and $\beta$ respectively with respect to a radial plane R which includes the central axis of the base member and extends outwardly through the circumferential center of the channel. Both acute angles open in a radially inward direction.

As best seen in FIG. 2, the forwardly facing side wall 24 of the channel and the first surface 41 of each blade include interengaging longitudinally extending corrugations, which serve to resist radially outward movement of the blade from the channel during the operative rotation of the shaper head.

As a specific example of a base member 12 which has a diameter of about 5.5 inches, the blade receptacle portion has a depth D1 of about 1.25 inches and a width W1 of about 0.375 inches. The gib receptacle portion has a depth D2 of about 1.0 inches and a width W2 at its upper surface of about 0.375 inches. An extension of the forwardly facing side wall 24 intersects the plane R at an angle $\alpha$ of about 15°, and an extension of the rearwardly facing side wall 28 intersects the plane R at an angle $\beta$ of about 5°. Also, it will be seen that both angles $\alpha$ and $\beta$ open radially inwardly toward the central axis of the base member.

To assemble the above described shaper head, the cutting blade and gib are inserted in the longitudinal direction from one end of the associated channel. This permits the base wall 46 of the blade to closely abut the base wall 22 of the channel, and the corrugations of the blade can deeply mesh with the corrugations of the forwardly facing side wall 24. Also, as noted above, the bottom wall 54 of the gib preferably contacts the base wall 26 of the channel. To complete the assembly, the set screws 30 are tightened to engage the front wall 52 of the gib and thereby bias the gib into firm engagement with the second surface 42 of the cutting blade.

Should the set screws 30 become loose during operative rotation of the shaper head, the centrifugal force will act on the gib, and the wedge-like configuration of the gib will cause it to continue its biasing force against the cutting blade. The release of the blade is thereby effectively prevented. Also, the gib cannot drop down into the channel to release the blade, since it is in engagement with the base wall 26 of the channel.

It is common to utilize blades 40 which have a longitudinal length less than the longitudinal length of the associated channel. In such cases, the gibs can be subjected to high levels of torque by the set screws in those areas of the gib which do not engage the blade, and such torque can fracture the gib. In accordance with the present invention, it has been found that the risk of fracturing can be effectively avoided by fabricating the gib of a relatively soft steel. Specifically, it has been found that gibs having a hardness of less than about 15 on the Rockwell C scale, and preferably less than about 10 Rockwell C, have been effective in avoiding the risk of fracture.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A shaper head for use with woodworking equipment and comprising a cylindrical base member defining a central axis which extends in a longitudinal direction, and having at least one longitudinally extending channel in the outer surface thereof, with said channel having a forwardly facing side wall and an opposing rearwardly facing side wall, a cutting blade positioned in said channel and including a first surface overlying and engaging said forwardly facing side wall of said channel, and a second surface facing said rearwardly facing side wall of said channel in a spaced apart arrangement, and such that the second surface of said blade and the rearwardly facing side wall of said channel lie in respective planes which are each inclined at an acute angle with respect to a radial plane which includes said central axis and passes outwardly through said channel, and such that said acute angles both open in a radially inward direction, and a gib of wedge shape in cross section disposed in said channel, said gib including a rear wall overlying and engaging said second surface of said blade, and a front wall overlying and engaging said rearwardly facing side wall of said channel, said forwardly facing side wall of said channel and said first surface of said cutting blade having interengaging longitudinally extending corrugations which serve to resist radially outward movement of the blade from the channel, and said base member including at least one threaded opening extending in a generally circumferential direction and communicating with said rearwardly facing side wall of said channel, and a set screw threadedly received in said one threaded opening so as to engage said front wall of said gib.

2. The shaper head as defined in claim 1 wherein said gib is composed of a steel having a hardness less than about 15 on the Rockwell C scale.

3. The shaper head as defined in claim 1 wherein each of said acute angles is at least about 5 degrees.

4. The shaper head as defined in claim 3 wherein said acute angles collectively total at least about 20 degrees.

5. The shaper head as defined in claim 1 wherein said first and second surfaces of said blade are generally parallel to each other, and wherein said blade includes an outer cutting edge which lies outside said channel and extends in a generally longitudinal direction.

6. The shaper head as defined in claim 1 wherein said base member further includes a central bore extending therethrough along said central axis.

7. A shaper head for use with woodworking equipment and comprising a cylindrical base member defining a central axis which extends in a longitudinal direction, and having at least one longitudinally extending channel in the outer surface thereof, with said channel having a forwardly facing side wall and an opposing rearwardly facing side wall, a cutting blade positioned in said channel and including a first surface overlying and engaging said forwardly facing side wall of said channel, and a second surface facing said rearwardly facing side wall of said channel in a spaced apart arrangement, and such that the second surface of said blade and the rearwardly facing side wall of said channel lie in respective planes which converge toward each other in a radially outward direction, and a gib of wedge shape in cross section disposed in said channel, said gib including a rear wall overlying and engaging said second surface of said blade, and a front wall overlying and engaging said rearwardly facing side wall of said channel, and wherein said second surface of said blade and said rearwardly facing side wall of said channel are each inclined at an acute angle with respect to a radial plane which includes said central axis and passes outwardly through said channel, and such that said acute angles both open in a radially inward direction, and said base member including at least one threaded opening extending in a generally circumferential direction and communicating with said rearwardly facing side wall of said channel, and a set screw threadedly received in said threaded opening so as to engage said front wall of said gib.

8. The shaper head as defined in claim 7 wherein said first and second surfaces of said blade are generally parallel to each other, and wherein said blade includes an outer cutting edge which lies outside said channel and extends in a generally longitudinal direction.

9. The shaper head as defined in claim 8 wherein said base member further includes a central bore extending therethrough along said central axis.

10. The shaper head as defined in claim 9 wherein said rearwardly facing side wall of said channel intersects said radial plane at an angle of about 5 degrees, and said second surface of said blade intersects said radial plane at an angle of about 15 degrees.

11. The shaper head as defined in claim 9 wherein said base member includes a plurality of said channels spaced equally about the circumference of said base member, and each of said channels mounts a cutting blade which corresponds to said first mentioned cutting blade and a gib which corresponds to said first mentioned gib.

12. The shaper head as defined in claim 11 wherein said base member further includes a plurality of threaded openings extending in a generally circumferential direction and with at least one of said threaded openings communicating with said rearwardly facing side wall of each of said channels, and a set screw threadedly received in each of said threaded openings so as to engage said front wall of the associated gib.

13. The shaper head as defined in claim 7 wherein said channel has a base wall, and wherein said gib has a bottom wall which is disposed immediately adjacent at least a portion of said base wall of said channel.

14. The shaper head as defined in claim 7 wherein the gib is composed of a steel having a hardness less than about 15 on the Rockwell C scale.

* * * * *